US009272549B2

(12) United States Patent
Horie

(10) Patent No.: US 9,272,549 B2
(45) Date of Patent: Mar. 1, 2016

(54) RECORDING APPARATUS

(71) Applicant: SEIKO EPSON CORPORATION, Tokyo (JP)

(72) Inventor: Seijun Horie, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/227,554

(22) Filed: Mar. 27, 2014

(65) Prior Publication Data

US 2014/0291438 A1 Oct. 2, 2014

(30) Foreign Application Priority Data

Mar. 29, 2013 (JP) ..... 2013-071627

(51) Int. Cl.
*B65H 15/00* (2006.01)
*B65H 23/185* (2006.01)
*B41J 15/04* (2006.01)

(52) U.S. Cl.
CPC ..... *B41J 15/046* (2013.01); *B41J 15/042* (2013.01); *B65H 23/185* (2013.01); *B65H 2404/147* (2013.01); *B65H 2511/514* (2013.01); *B65H 2511/518* (2013.01); *B65H 2553/41* (2013.01); *B65H 2553/46* (2013.01); *B65H 2553/51* (2013.01); *B65H 2801/36* (2013.01)

(58) Field of Classification Search
CPC .. B65H 23/0204; B65H 23/02; B65H 23/185; B65H 9/18; B65H 2401/22; B65H 2407/22; B41J 5/042; B41J 5/046
USPC ..... 271/226, 241
See application file for complete search history.

(56) References Cited

U.S. PATENT DOCUMENTS 5,951,181 A * 9/1999 Hierro et al. ..... 400/645
2011/0076084 A1* 3/2011 Kasugai et al. ..... 400/613

FOREIGN PATENT DOCUMENTS

JP 05-058475 A 3/1993
JP 05-082964 U 3/1993
JP 05-085693 U 11/1993
JP 10-214659 A 1/1997

* cited by examiner

*Primary Examiner* — Patrick Cicchino
(74) *Attorney, Agent, or Firm* — Maschoff Brennan

(57) ABSTRACT

A recording apparatus includes a medium support section that has a supply section supplying a continuous-shaped recording medium, a medium path through which the recording medium supplied on the supply section passes, and a transportation mechanism that transports the recording medium; and a recording section that performs recording on the recording medium passing through the medium path. A hole that is formed in a side wall having a light shielding property and capable of visually recognizing the inside of the medium path on the upstream side from the transportation mechanism in a transportation direction through the inside of the medium support section is provided in the medium support section.

8 Claims, 6 Drawing Sheets

RECORDING APPARATUS

BACKGROUND

1. Technical Field

The present invention relates to a recording apparatus.

2. Related Art

In a recording apparatus such as a large-sized ink jet printer, recording is performed by transporting a rolled paper (a recording medium) that is mounted on a rolled paper holder from a supply port (a supply section) to a recording section through a medium path. Further, there is also a recording apparatus including an automatic paper feeding mechanism that automatically transports a leading end section of a rolled paper inserted into a supply port to a recording section by holding the leading end section between a pair of paper feeding rollers. In a paper feeding motor configuring the paper feeding mechanism, since light is emitted from an encoder or the like, the paper feeding mechanism and the like are provided inside an internal housing to suppress visual reorganization of the light that is emitted from the paper feeding mechanism and the like. The medium path of the recording apparatus is narrow because the paper feeding mechanism and the like are provided. Generally, when using a new rolled paper, it is necessary for a user to perform work for supplying the rolled paper to the paper feeding mechanism by inserting the leading end section of the rolled paper into a narrow supply port that is inside the apparatus by hands.

Moreover, a sheet recording apparatus disclosed in JP-A-5-58475 includes a plurality of stages of paper feeding cassettes storing a plurality of cut sheets, and a part of each paper feeding cassette on a drawing-out side is transparently formed.

When setting the rolled paper, it is preferable that the position of the leading end section of the rolled paper be visually recognized immediately before the pair of paper feeding rollers. However, in a case where a narrow medium path through which the rolled paper passes is located behind the paper feeding mechanism and the like as viewed by the user, it is impossible to visually recognize the position of the leading end section of the rolled paper that is inserted into the supply port and is inside the medium path. Since the rolled paper is not correctly transported when the leading end section of the rolled paper inserted into the medium path is deviated obliquely beyond an allowable range, work for inserting the leading end section of the rolled paper so as not to deviate by exceeding the allowable range thereof is troublesome.

The sheet recording apparatus disclosed in JP-A-5-58475 is technology that feeds the cut sheets stored in the paper feeding cassettes and since it is impossible to visually recognize the inside of the medium path in the vicinity of the paper feeding mechanism, it is not technology that solves the problem described above.

Moreover, the problems described above are not limited to the ink jet printer and are similarly present in various recording apparatuses.

SUMMARY

An advantage of the some aspects of the invention is to provide a recording apparatus capable of suppressing visual reorganization of light inside a medium support section such as a transportation mechanism and capable of visually recognizing a position of a leading end section of a recording medium that is inside a medium path on an upstream side of the transportation mechanism.

According to an aspect of the invention, there is provided a recording apparatus including: a medium support section that has a supply section to which a continuous-shaped recording medium is supplied, a medium path through which the recording medium supplied to the supply section passes, and a transportation mechanism that transports the recording medium; and a recording section that performs recording on the recording medium passing through the medium path, in which a hole that is formed in a side wall having a light shielding property and capable of visually recognizing the inside of the medium path on the upstream side from the transportation mechanism in a transportation direction through the inside of the medium support section is provided in the medium support section.

That is, the hole provided in the medium support section is capable of visually recognizing the inside of the medium path on the upstream side from the transportation mechanism in the transportation direction through the inside of the medium support section. Therefore, even if the medium path through which the recording medium passes is located behind the transportation mechanism or the like as viewed from a user, it is possible to visually recognize the leading end section of the recording medium that is supplied to the supply section and is inside the medium path, and it is possible to reduce work for supplying the leading end section of the recording medium to the supply section so as not to deviate by exceeding an allowable range thereof. Further, the visual reorganization of the light inside the medium support section is suppressed in the side wall of the hole having the light shielding property. Therefore, in this aspect described above, it is possible to provide the recording apparatus which is capable of suppressing the visual reorganization of the light inside the medium support section such as the transportation mechanism and is capable of visually recognizing the position of the leading end section of the recording medium that is inside the medium path on the upstream side of the transportation mechanism.

Here, in the recording apparatus, an ink jet printer, a wire dot printer, a laser printer, a line printer, a copier, a facsimile machine and the like are included.

In the continuous-shaped recording medium, a roll-shaped recording medium, a folded recording medium and the like are included.

The light shielding property is not limited to a case where the light is completely shielded and includes a case where a part of the light is transmitted. Therefore, the side wall having the light shielding property may shield at least a part of the light.

However, in the recording apparatus, the medium support section may be capable of relatively moving with respect to the recording section. An opening of the hole on the side opposite the medium path may be exposed when the medium support section relatively moves from a position in which the recording medium is transported to the recording section. In this aspect, since the hole is hidden during the recording, the technology can suppress scratching of the recording medium due to foreign matter entering from the hole. Further, the case where the medium support section relatively moves includes a case where the recording section does not move and the medium support section moves, a case where the medium support section does not move and the recording section moves, and a case where both the recording section and the medium support section move.

In the recording apparatus, the opening of the hole on the side opposite the medium path may be wider than that of the hole on the side of medium path. In this aspect, an external light is likely to enter the hole, the inside of the medium path is bright and it is possible to easily visually recognize the inside of the medium path.

In the recording apparatus, a plurality of holes may be provided in positions which are different in a width direction of the recording medium passing through the medium path. In this aspect, it is possible to provide the recording apparatus which is capable of visually recognizing parallelism of the recording medium that is inside the medium path on the upstream side of the transportation mechanism.

In the recording apparatus, the transportation mechanism may have a detector that detects presence or absence of the recording medium inside the medium path. If the presence or the absence of the recording medium inside the medium path can be detected, it is possible to automatically transport the recording medium when the presence of the recording medium is detected. Therefore, in this aspect, it is possible to provide the recording apparatus that is convenient in which the position of the recording medium inside the medium path is capable of being visually recognized.

In the recording apparatus, the medium support section may have an internal housing in which at least the transportation mechanism is provided. The side wall forming the hole may be configured as a separate member that is mounted on the internal housing. In this aspect, it is possible to provide the recording apparatus which is capable of visually recognizing the position of the recording medium that is inside the medium path on the upstream side of the transportation mechanism with a simple configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described. Of course, the embodiment described below is merely illustrative of the invention and not all of the characteristics illustrated in the embodiment may become essential for means for solving the problems of the invention.

Figure 1:
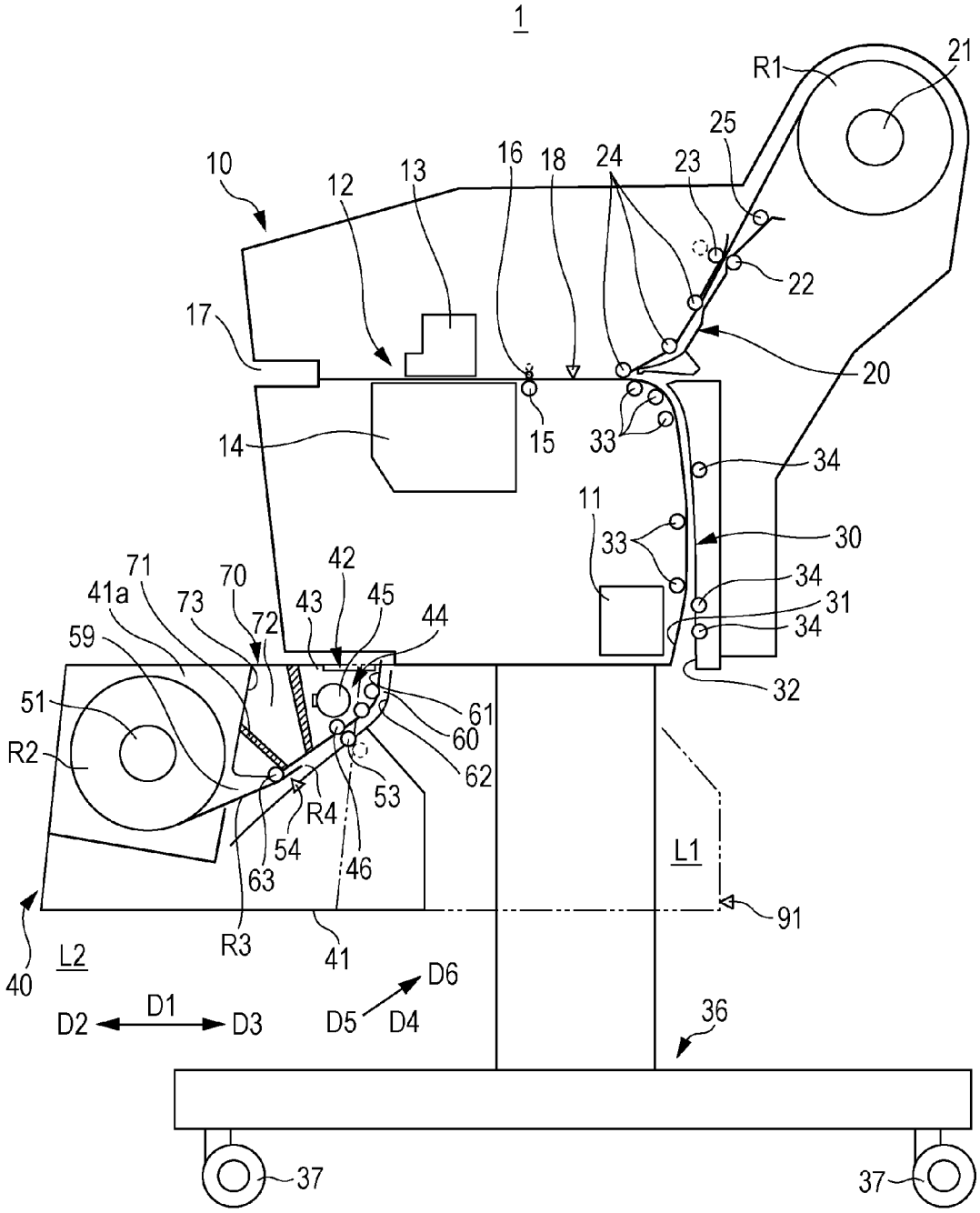
FIG. 1 is a vertical cross-sectional view illustrating a recording apparatus in a state where a paper feeding unit (a medium support section) is drawn out.
Figure 2A:
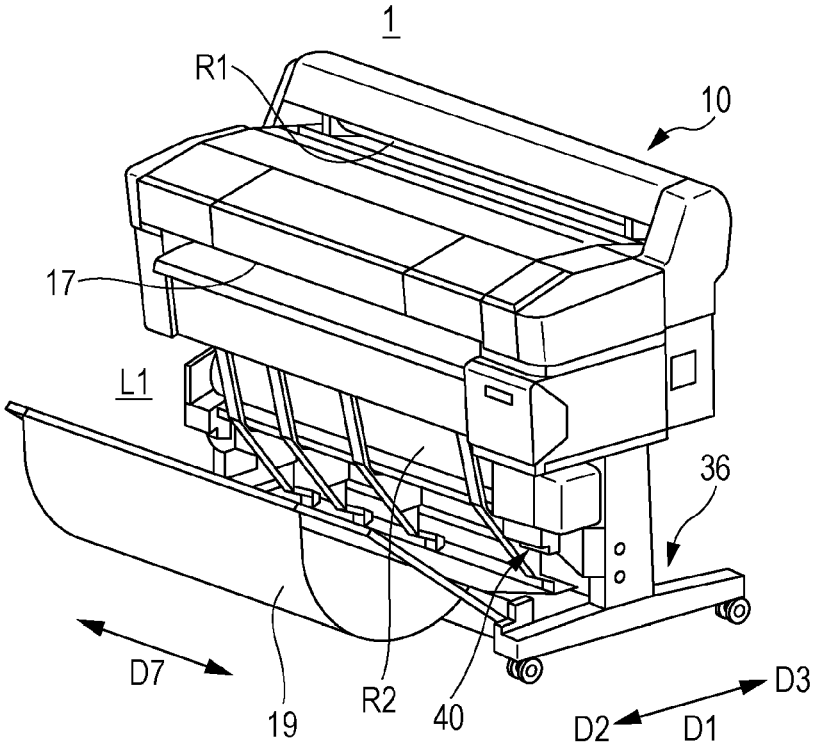
FIGS. 2A and 2B are perspective views illustrating an exterior of the recording apparatus.
Figure 2B:
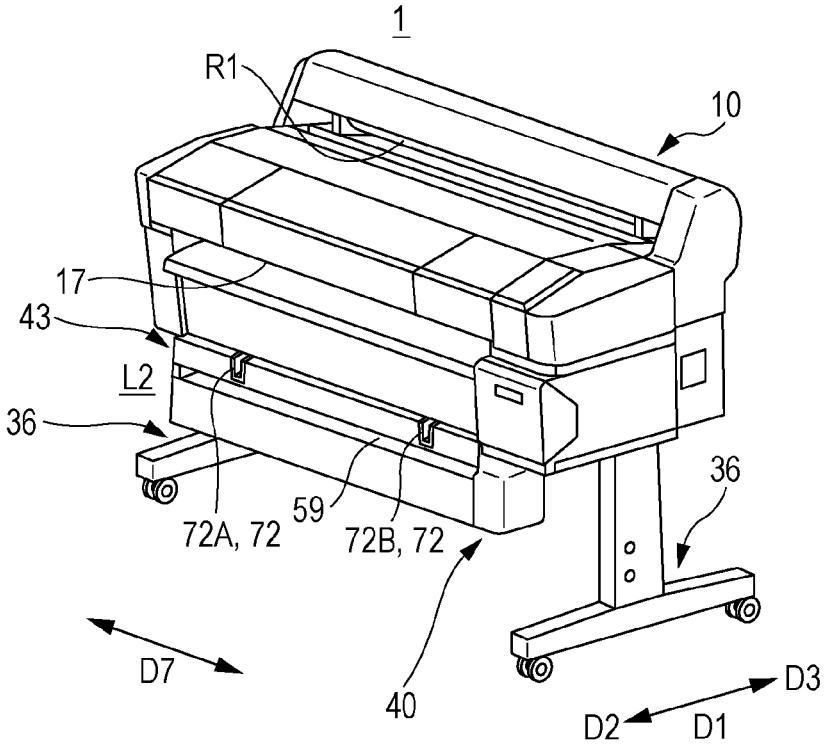
Figure 3:
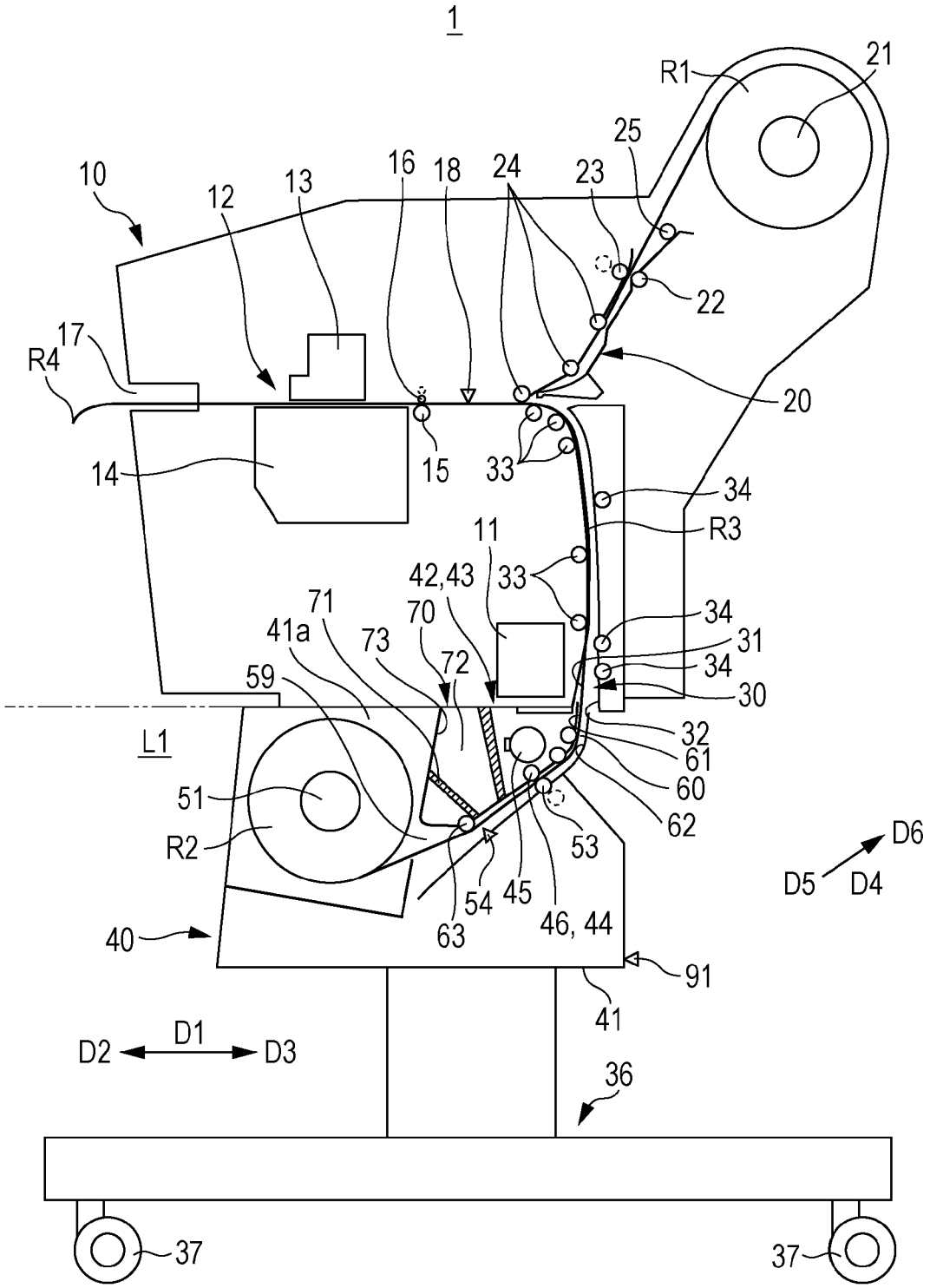
FIG. 3 is a vertical cross-sectional view illustrating the recording apparatus in a state where the paper feeding unit is stored.
Figure 4A:
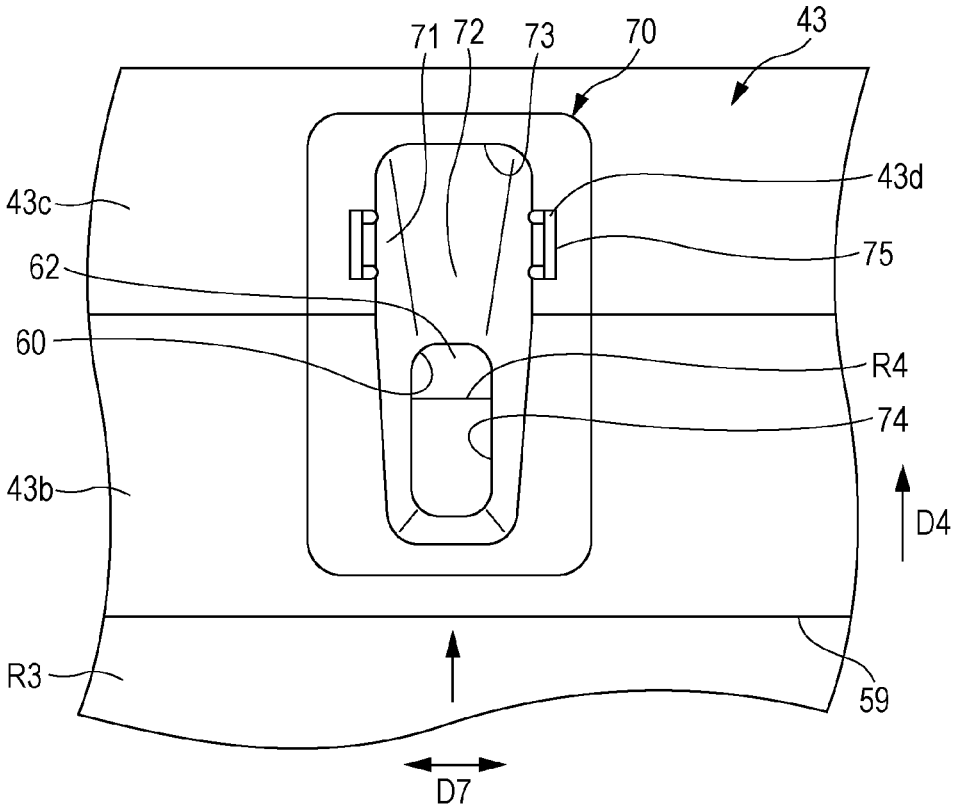
FIG. 4A is a perspective view illustrating a window member (a separate member) and the like and FIG. 4B is a vertical cross-sectional view schematically illustrating an appearance that the window member is mounted on an internal housing.
Figure 4B:
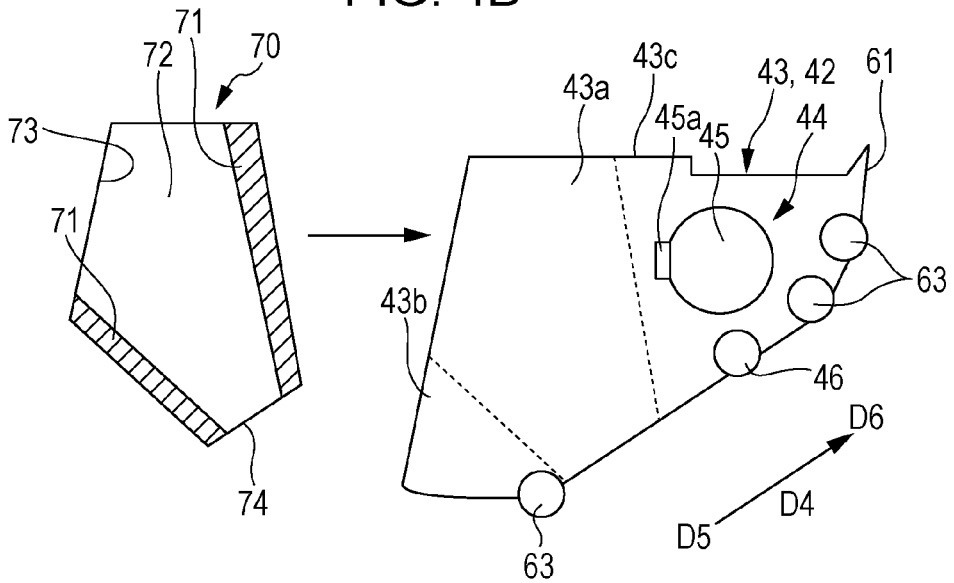
Figure 5:
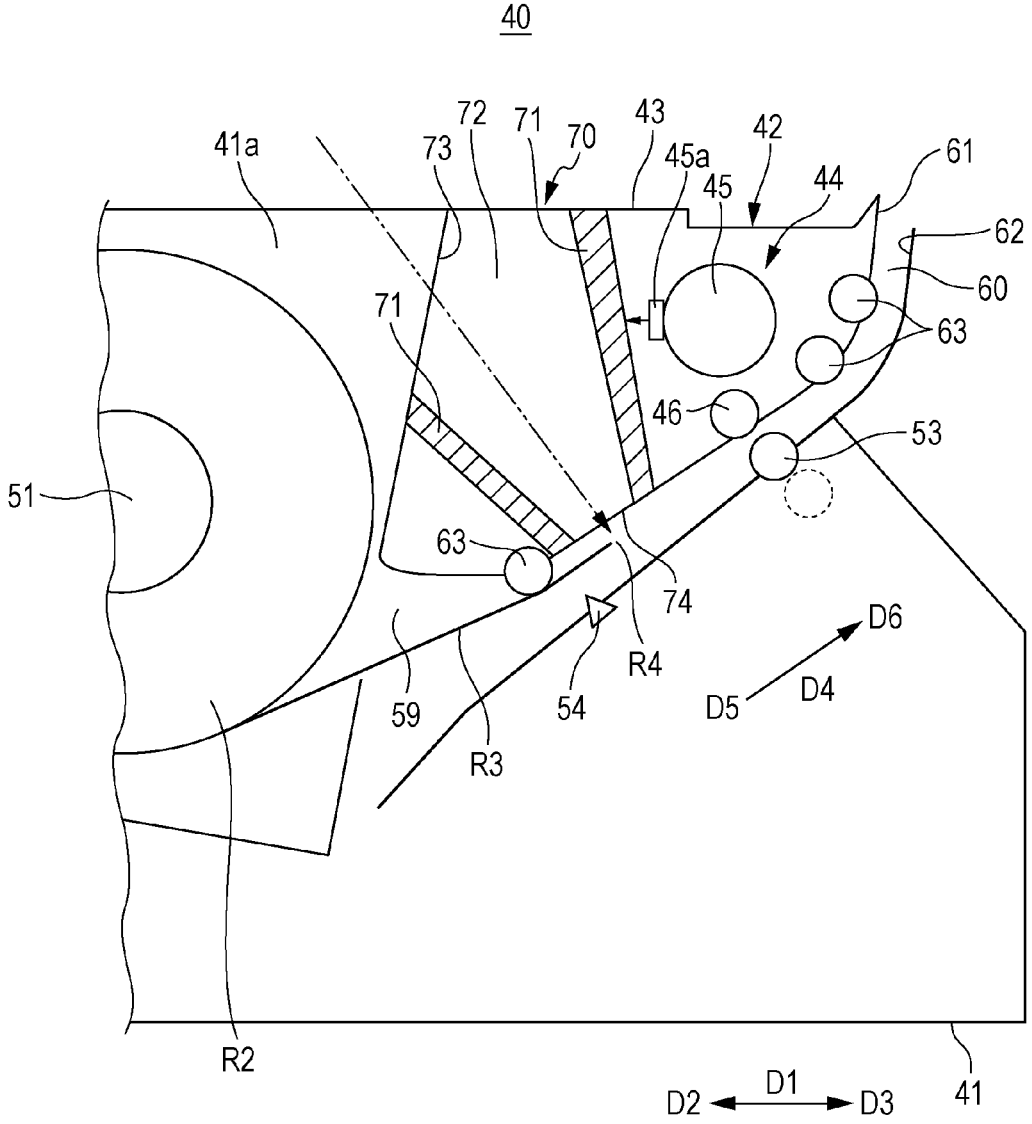
FIG. 5 is a vertical cross-sectional view illustrating a main portion of the paper feeding unit.

FIG. 1 is a vertical cross-sectional view illustrating a large-sized ink jet printer as an example of a recording apparatus 1 and illustrates a state where a paper feeding unit (a medium support section) 40 is in a predetermined drawn out position L2 by omitting a stacker 19. FIGS. 2A and 2B are perspective views illustrating an exterior of the recording apparatus 1, FIG. 2A illustrates a state where the paper feeding unit 40 is in a predetermined storage position L1 and FIG. 2B illustrates a state where the paper feeding unit 40 is in the drawn out position L2 by omitting a part thereof. FIG. 3 is a vertical cross-sectional view illustrating the recording apparatus 1 in a state where the paper feeding unit 40 is in the storage position L1 by omitting the stacker 19. The storage position L1 is a position in which a recording medium R3 passes through medium paths 30 and 60, and is a position in which the recording medium R3 is transported to a recording section 12. FIG. 4A is a perspective view illustrating a window member 70 and an internal housing 43 in the vicinity thereof. FIG. 4B is a vertical cross-sectional view schematically illustrating an appearance that the window member 70 that is a separate member is mounted on the internal housing 43. FIG. 5 is a vertical cross-sectional view illustrating a main portion of the paper feeding unit 40.

In the views described above, a reference numeral D1 illustrates a slide direction of the paper feeding unit 40 with respect to a body 10. A reference numeral D2 is one side of the slide direction D1 and illustrates a drawing out direction from the storage position L1 toward the drawn out position L2. A reference numeral D3 is the other side of the slide direction D1 and illustrates a storage direction from the drawn out position L2 toward the storage position L1. A reference numeral D4 is a transportation direction of the recording medium R3 and the transportation direction D4 illustrated in the view crosses the slide direction D1. A reference numeral D5 illustrates an upstream side in the transportation direction D4 and a reference numeral D6 illustrates a downstream side of the transportation direction D4. A reference numeral D7 is a width direction of the recording medium R3 and illustrates a width direction of the recording apparatus orthogonal to the slide direction D1 and the transportation direction D4 in the example illustrated in the view. FIGS. 1 and 3 are side views of the recording apparatus 1 viewed from the outside thereof in the width direction D7.

Moreover, in order to simply illustrate, respective views are not consistent.

Further, a positional relationship described in the specification is merely exemplary for describing the invention and is not intended to limit the invention. Therefore, for example, the paper feeding unit that is disposed in a position other than a lower side of the body, for example, an upper side, a left side or a right side is also included in the invention.

The recording apparatus 1 illustrated in the views described above includes the body 10 having the recording section 12, and the paper feeding unit 40 that is provided to be capable of relatively moving with respect to the body 10. It is possible to print (to record) by switching a first rolled paper R1 in an upper back section of the apparatus and a second rolled paper R2 in a lower section of the apparatus. The rolled paper is a continuous sheet wound as a roll-shaped sheet. In both rolled papers R1 and R2, a printing surface is an outer surface. Of course, if the position of delivery mechanisms 21 and 51 is changed, the rolled paper in which an inner surface is the printing surface may be used. As the rolled paper, it is possible to use a winding recording medium having various materials such as paper, cloth, a plastic sheet, and leather.

As illustrated in FIG. 1 and the like, the body 10 has a control section 11, the recording section 12, transportation roller pair 15 and 16, a discharging section 17, a cutter 18, the stacker 19, a medium path 20 and paper feeding mechanisms 21 to 25 for a first rolled paper, and the first medium path 30 and rollers (driven rollers) 33 and 34 for a second rolled paper. Further, the body 10 is supported on leg sections 36 having casters 37.

The control section 11 has a Central Processing Unit (CPU), a Read Only Memory (ROM), a Random Access Memory (RAM) and the like, and controls an operation of each section of the recording apparatus 1, for example, printing on the recording medium by receiving a command of an recording output from an external host device. The recording medium that is a printing object is a portion that is drawn out from one of the rolled papers R1 and R2, and is the continuous sheet-shaped recording medium R3 when the recording medium is the second rolled paper R2.

The recording section 12 has a recording head 13 and a platen 14, and performs printing on the recording medium passing through the medium path. The recording head 13 is disposed on an upper side facing the platen 14 and is capable of recording by discharging ink with respect to the recording medium. The platen 14 supports the recording medium and makes a distance between the recording medium and the recording head 13 be a predetermined distance.

The transportation roller pair 15 and 16 includes a driving roller 15 disposed on the lower side and a driven roller 16 disposed on the upper side. The driven roller 16 is capable of separating from the driving roller 15 and holds the recording medium with the driving roller 15 when the driven roller 16 approaches the driving roller 15.

When the recording medium that is delivered from the discharging section 17 is released from the holding of the transportation roller pair 15 and 16 after being cut by the cutter 18, the recording medium is stacked on the stacker 19.

The paper feeding mechanism for the first rolled paper includes the delivery mechanism 21 that supports the first rolled paper R1, paper feeding roller pair 22 and 23, rollers (driven rollers) 24 and 25, and the like. The paper feeding roller pair 22 and 23 includes a driving roller 22 disposed on the side of the storage direction D3 and a driven roller 23 disposed on the side of the drawing out direction D2. The driven roller 23 is capable of separating from the driving roller 22 and holds the recording medium with the driving roller 22 when the driven roller 23 approaches the driving roller 22.

When feeding the first rolled paper R1 that is newly mounted on a rolled paper holder of the delivery mechanism 21, first, a user enters a leading end section of the rolled paper R1 between the paper feeding roller pair 22 and 23. Thereafter, the delivery mechanism 21 delivers the rolled paper R1 and the delivered recording medium is held by the paper feeding roller pair 22 and 23 and then is transported to the side of the transportation roller pair 15 and 16. Thereafter, the transportation roller pair 15 and 16 holds the recording medium. When printing, the transportation roller pair 15 and 16 transports the recording medium on the platen 14 and the recording head 13 discharges the ink and then the recording is performed on the recording medium.

The first medium path 30 through which the recording medium R3 that is transported to the recording section 12 passes has a first one side wall section 31 on the side of the drawing out direction D2 in which the roller 33 is provided, and a first other side wall section 32 on the side of the storage direction D3 in which the roller 34 is provided.

The paper feeding unit (the medium support section) 40 includes a supply port (a supply section) 59 through which the second rolled paper (the continuous recording medium) R2 is supplied, a second medium path 60 through which the recording medium R3 supplied to the supply port 59 passes, paper feeding mechanisms 42, 51, 53 and 54, and the like. Each section is stored in an external housing 41. The supply port 59 is formed in a slot shape in such a manner that a longitudinal direction thereof is in the width direction D7 of the recording medium. Of course, the shape of the support section through which the recording medium is supplied is not limited to the slot shape. The paper feeding unit 40 is capable of sliding between the storage position L1 and the drawn out position L2, and is electrically connected to the control section 11. The recording apparatus 1 includes a position detection sensor 91 detecting whether or not the paper feeding unit 40 is in the storage position L1, and does not perform an automatic paper feeding operation when the paper feeding unit 40 is not detected in the storage position L1.

The second medium path 60 through which the recording medium R3 transported in the first medium path 30 passes has a second one side wall section 61 on the side of the drawing out direction D2, and a second other side wall section 62 on the side of the storage direction D3. The second one side wall section 61 becomes an inner portion of the second medium path 60 that is bent from the delivery mechanism 51, and has a roller (driven roller) 63. The medium path 60 is narrowed to transport the sheet-shaped recording medium R3.

The paper feeding mechanism for the second rolled paper includes the mechanical section 42 on which the window member 70 is mounted, the delivery mechanism 51 that supports the second rolled paper R2, the driven roller 53, the medium detection sensor (a detector) 54 detecting presence or absence of the recording medium R3 inside the medium path 60, and the like.

The mechanical section 42 includes the light shieldable internal housing 43 provided in an inner section 41*a* of the external housing 41 and a transportation mechanism 44 provided in an inner section of the internal housing 43. As illustrated in FIG. 2B, the internal housing 43 is formed in an elongated shape in such a manner that the longitudinal direction thereof is toward the width direction D7. As illustrated in FIG. 4B and the like, a mounting section 43*a* for mounting the window member 70, which reaches from a position extending over a front section 43*b* and an upper section 43*c* to the one side wall section 61 of the medium path, is formed in the inner section of the internal housing 43. The mounting section 43*a* is provided at two locations which are eccentrically distributed on both sides in the width direction D7 with respect to the internal housing 43. In the example illustrated in FIG. 4A, a convex fitting section 43*d* to be fitted to a fitting section 75 of the window member 70 is provided in the mounting section 43*a*. A driving roller 46 configuring a roller of one side of paper feeding roller pair 46 and 53 is provided in the wall section 61. A motor 45 that is a servo motor having an encoder 45*a* is stored inside the internal housing 43. The motor 45 rotatably drives the driving roller 46 according to an instruction from the control section 11.

Light is emitted from the encoder 45*a*. In order to prevent the light emitted from the encoder or the like from entering eyes of the user, the motor 45 is stored in the light shieldable internal housing 43.

The driven roller 53 configures a roller of the other side of the paper feeding roller pair 46 and 53. The driven roller 53 is capable of separating from the driving roller 46 and holds the recording medium R3 with the driving roller 46 when the driven roller 53 approaches the driving roller 46. The medium detection sensor 54 illustrated in FIG. 5 and the like detects whether or not the recording medium R3 is supplied in front of the paper feeding roller pair 46 and 53 in the second medium path 60. The medium detection sensor 54 illustrated in FIG. 5 and the like is in the upstream side D5 of the transportation mechanism from a hole 72, but the position of the medium detection sensor is not limited to the embodiment as long as the position of the medium detection sensor is in a position capable of detecting presence or absence of the recording medium in the medium path. It is possible to detect the presence or the absence of the recording medium R3 in the medium path 60 by the medium detection sensor 54, and it is possible to automatically transport the recording medium R3 when the recording medium R3 is detected.

Each window member 70 mounted on each mount section 43*a* of the internal housing 43 has the hole 72 formed in a light shieldable side wall 71. The hole 72 is not a simple opening of the wall but functions as "a peephole" capable of peeping the inside of the medium path 60 through the mechanical section 42.

Since the medium path 60 is covered by the wall sections 61 and 62, the medium path 60 is narrow and it is difficult to view the inside thereof. In a case where a narrow medium path through which the recording medium passes is located behind the light shieldable internal housing 43 (the mechanical section 42) as viewed by the user, if there is no hole 72 described above, it is impossible to visually recognize the position of the leading end section of the recording medium in the medium path, which is inserted into the supply port. In a case where the position of the leading end section of the recording medium cannot be visibly recognized because the leading end section of the recording medium inserted into the medium path is deviated obliquely beyond an allowable range and then the recording medium is not correctly transported, an inserting work of the leading end section of the recording medium into the supply port so as not to be beyond the allowable range is troublesome. Thus, the recording apparatus 1 has the hole 72 that functions as "the peephole" described above.

The side wall 71 illustrated in FIG. 4B is configured of a separate member that is mounted on the internal housing 43 so as to pass through the mechanical section 42. Since there is the side wall 71 in the window member 70 functioning as "a peeping window", the hand of the user does not come into contact with the transportation mechanism 44 in the internal housing 43 and foreign matter such as a clip does not enter the transportation mechanism 44. The light shieldable side wall 71 may completely block the light, but may transmit a part of the light. As a material of the side wall, it is possible to use various opaque media or semi-transparent materials, and it is possible to use one or more materials of, for example, a synthetic resin that is not transparent, an elastomer that is not transparent, metal, and the like. Of course, it is also possible to use a material in which a light shielding material such as a colorant is added and applied to a transparent synthetic resin or elastomer. Since the side wall 71 of the window member 70 passing through the inside of the internal housing 43 has the light shielding property, as illustrated in FIG. 5, it is possible to prevent the emitted light from being transmitted through the side wall 71 even if the light is emitted from the encoder 45*a* or the like inside the internal housing 43.

In FIG. 2B, a hole 72A is disposed in the internal housing 43 of one side in the width direction that is the left side when viewed from the front of the recording apparatus 1, and a hole 72B is disposed in the internal housing 43 of the other side in the width direction that is the right side. Therefore, a plurality of holes 72 provided in the paper feeding unit 40 are provided in different positions in the width direction D7 of the recording medium R3 passing through the medium path 60. Each hole 72 is "the peephole" visibly recognizing the inside of the medium path 60 of the upstream side D5 from the driving roller 46 (the transportation mechanism 44) in the transportation direction through the inside of the mechanical section 42, that is, the inner section 41*a* of the paper feeding unit 40. Moreover, the medium path 60 of the upstream side D5 from the driving roller 46 in the transportation direction is the medium path between the supply port 59 and the driving roller 46.

The hole 72 illustrated in FIGS. 1 to 5 is gradually thinned from an opening 73 on the front side disposed in the front section 43*b* and the upper section 43*c* to an opening 74 on the back side disposed in the wall section 61. That is, the opening 73 that is on the front side opposite the medium path 60 is wider than the opening 74 on the back side that is the side of the medium path 60. A shape of a cross section of the hole 72 is a substantially rectangular shape having rounded corners. Of course, the shape of the cross section of the hole 72 may be a shape of which a longitudinal direction is elongated in the width direction D7.

The slit-shaped fitting section 75 fitting the convex fitting section 43*d* of the internal housing 43 is formed in the window member 70 illustrated in FIG. 4A. Of course, the structure of the fitting sections 43*d* and 75 is not limited to the combination of the convex section and the slit.

As illustrated in FIG. 3, when the paper feeding unit 40 is in the storage position L1, the internal housing 43 having the hole 72 is hidden under the body 10. When the paper feeding unit 40 slidingly moves (relatively moves) from the storage position L1 to the drawn out position L2, as illustrated in FIG. 1, the internal housing 43 in which the hole 72 is provided is in a position that is viewed from the outside and the opening 73 of the front side of the hole 72 is exposed. At this time, as illustrated in FIG. 4A, the user can visually recognize the inside of the medium path 60 of the upstream side D5 from the driving roller 46 in the transportation direction through the hole 72. FIG. 4A illustrates that a leading end section R4 of the recording medium R3 and the other side wall section 62 of the medium path 60 are viewed from the opening 74 of the back side.

When feeding the second rolled paper R2 that is newly mounted on the rolled paper holder of the delivery mechanism 51, the user makes the leading end section R4 of the rolled paper R2 enter the supply port 59. Thereafter, when the user stores the paper feeding unit 40 in the storage position L1, the medium detection sensor 54 detects the presence of the recording medium R3 in the medium path 60 that is in the upstream side D5 from the paper feeding roller pair 46 and 53 in the transportation direction. Then, the delivery mechanism 51 delivers the rolled paper R2 and the paper feeding roller pair 46 and 53 holds the recording medium R3 that is delivered in the second medium path 60 and then transports the recording medium R3 to the side of the first medium path 30. Then, the transportation roller pair 15 and 16 holds the recording medium R3 that passes through the first medium path 30 and is transported between the transportation roller pair 15 and 16. Thereafter, the paper feeding roller pair 46 and 53 may release the recording medium R3 from the holding. The above is the automatic paper feeding operation. When performing the printing (when recording), the transportation roller pair 15 and 16 transports the recording medium R3 on the platen 14 and the recording head 13 discharges the ink and then the recording is performed on the recording medium R3. The control section 11 controls a series of the operation.

Next, the operation and effect of the recording apparatus 1 are described.

When the rolled paper R2 is newly mounted on the paper feeding unit 40, first, the user draws the paper feeding unit 40 out from the storage position L1 to the drawn out position L2. Then, as illustrated in FIG. 2B, since the paper feeding unit 40 is in the position in which the supply port 59 is viewed, the user can insert (supply) the leading end section R4 of the recording medium R3 that is drawn out from the rolled paper R2 into the supply port 59 using the hand. Further, as illustrated in FIG. 1, since the opening 73 of the front side of the hole 72 is exposed, the user visually recognizes the inside of the medium path 60 of the upstream side D5 from the driving roller 46 through the hole 72. Therefore, when setting the rolled paper, the position of the leading end section R4 of the recording medium is visually recognized immediately before the paper feeding roller pair 46 and 53.

Figure 6A:
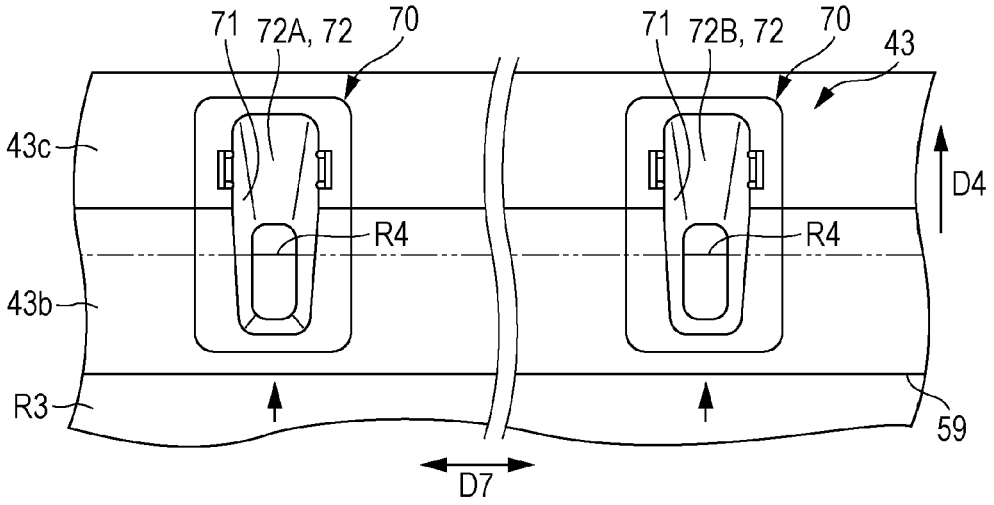
FIGS. 6A and 6B are perspective views illustrating an operation of the recording apparatus.
Figure 6B:
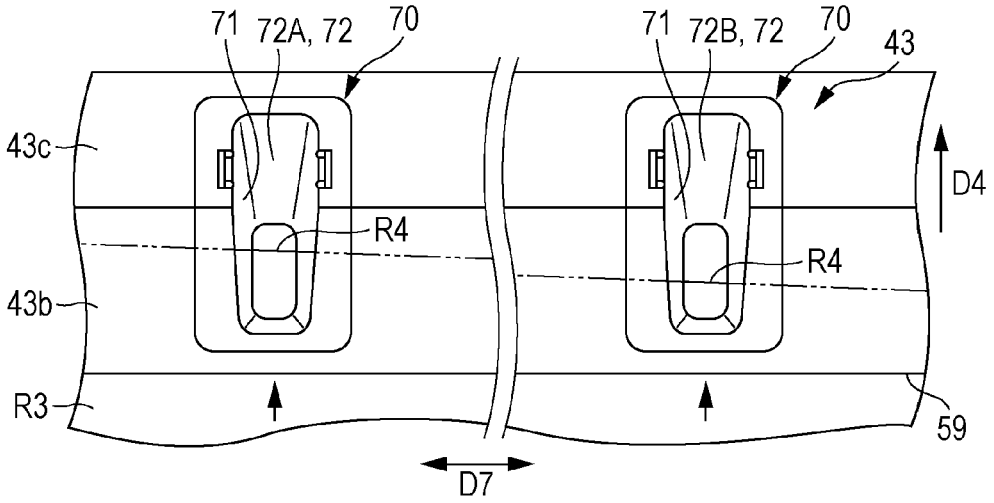

If there is no deviation exceeding the allowable range in the leading end section R4 of the recording medium inserted from the supply port 59, as illustrated in FIG. 6A, inclination of the leading end section R4 is within the allowable range and the position of the leading end section R4 in the transportation direction D4 viewed from each of the holes 72A and 72B is substantially aligned. In contrast, if there is deviation exceeding the allowable range in the leading end section R4, as illustrated in FIG. 6B, the inclination of the leading end section R4 exceeds the allowable range and the position of the leading end section R4 in the transportation direction D4 viewed from each of the holes 72A and 72B is deviated beyond the allowable range. When the paper is fed in this state, it becomes skew feeding that is not correctly transported but since a state which is the skew feeding is viewed, the user can correct inclination of the leading end section R4 of the recording medium while peeping through the holes 72A and 72B.

As described above, even if the narrow medium path 60 through which the recording medium R3 passes is present behind the light shieldable internal housing 43 (the mechanical section 42) viewed by the user, it is possible to visually recognize the leading end section R4 of the recording medium that is inside the medium path 60 supplied from the supply port 59. Therefore, the technology can reduce the work for supplying the leading end section R4 of the recording medium to the supply port 59 so as not to deviate beyond the allowable range. Further, the visual reorganization of the light inside the paper feeding unit 40 such as the light or the like emitted from the encoder 45*a* is suppressed by the side wall 71 of the hole 72 having the light shielding property. Therefore, the technology can provide the recording apparatus capable of suppressing the visual reorganization of the light inside the medium support section such as the transportation mechanism, and capable of visually recognizing the position of the leading end section of the recording medium inside the medium path on the upstream side of the transportation mechanism. Further, since the plurality of holes 72 are provided in the positions different in the width direction D7 of the recording medium R3, it is possible to easily visually recognize parallelism of the leading end section R4 of the recording medium that is inside the medium path 60. Furthermore, since the side wall 71 forming the hole 72 is configured of a separate member that is mounted on the internal housing 43, it is possible to visually recognize the position of the leading end section R4 of the recording medium that is inside the medium path 60 with a simple configuration.

When the user stores the paper feeding unit 40 in the storage position L1 after inserting the leading end section R4 of the recording medium into the medium path 60, the medium detection sensor 54 detects the presence of the recording medium R3 inside the medium path 60 and the automatic paper feeding operation that transports the recording medium R3 is performed until the recording medium R3 is held by the transportation roller pair 15 and 16. Further, when the paper feeding unit 40 is in the storage position L1, the recording is performed on the recording medium R3. That is, since the recording is performed in a state where the hole 72 is hidden under the body 10, foreign matter such as a clip falling and entering the medium path 60 from the hole 72 is unlikely to occur during the recording. Therefore, the technology can suppress scratching of the recording medium R3 due to the foreign matter entering from the hole 72.

Furthermore, since the opening 73 of the hole 72 on the front side is wider than the opening 74 on the back side, external light easily enters the hole 72 and the inside of the medium path 60 becomes bright. Further, since the opening 74 on the back side is narrow, it is easy to correctly recognize the position of the leading end section R4 of the recording medium and to view the deviation of the leading end section R4. Meanwhile, since the opening 73 on the front side is wide, it is easy to visually recognize the position of the leading end section R4 of the recording medium. Therefore, this example can provide an example in which the inside of the medium path 60 is easily visually recognized.

Moreover, in the invention, various modification examples may be considered.

For example, the recording medium to which the invention is applicable may be a continuous sheet or the like that is folded other than the rolled paper.

The driving roller and the driven roller configuring the roller pair described above may be a reverse arrangement of the positional relationship described above. Further, the roller pair may be configured of a pair of driving rollers using the driving roller instead of the driven roller.

The recording apparatus may be an apparatus that performs the recording on one recording medium in addition to the apparatus that performs the recording by switching a plurality of recording media.

The medium support section may be a paper feeding unit or the like that supports the first rolled paper R1 on the upper back side of the apparatus.

In addition to the case where the recording section does not move and the medium support section moves between the storage position and the drawn out position, the medium support section does not move and the recording section may move between the storage position and the drawn out position, and both the medium support section and the recording section may move between the storage position and the drawn out position. Further, if the hole is provided in the medium support section so as not to be hidden in the body, the medium support section may not relatively move with respect to the recording section.

Only a transportation mechanism may be provided and elements such as the control section or the sensor other than the transportation mechanism may be provided in the internal housing in which the hole formed in the side wall is provided.

In addition to the case where the opening of the hole on the front side is provided in the position extending over the front section and the upper section of the internal housing, only the front section of the internal housing may be provided and only the upper section of the internal housing may be provided. Of course, the hole may be provided in any position of the medium support section and even if the internal housing is not provided, if the hole is provided through the inside of the medium support section, it is possible to apply the invention.

The number of the holes may be three or more and may be one. For example, a hole elongated to the extent of the holes 72A and 72B described above in the width direction D7 is provided, and it is possible to easily recognize the parallelism of the leading end section R4 of the recording medium.

Moreover, even a case where a transparent material is inserted into the hole described above is included in the invention. Further, even if the side wall forming the hole is not a separate member, cross-sectional areas of the hole are the same on the front side and the back side, and the opening of the hole on the front side is narrower than the opening on the back side, it is possible to obtain the effect that the position of the leading end section of the recording medium inside the medium path is capable of being visually recognized.

As described above, according to the invention, it is possible to suppress the visual reorganization of the light inside of the medium support section such as the transportation mechanism and it is possible to provide the technology capable of visually recognizing the position of the leading end section of the recording medium that is inside the medium path on the upstream side of the transportation mechanism. Of course, it is also possible to obtain the basic operation and effect described above even in the technology or the like that does not include configuration elements according to dependent claims but includes only configuration elements according to an independent claim.

Further, a configuration in which configurations disclosed in the embodiment and the modification example described above are replaced or combined with each other, a configuration in which configurations disclosed in the well-known technology, the embodiment and the modification example described above are combined or replaced with each other, and the like may be implemented. The invention also includes the above described configurations and the like.

The entire disclosure of Japanese Patent Application No. 2013-071627, filed Mar. 29, 2013 is expressly incorporated by reference herein.

What is claimed is:

1. A recording apparatus, comprising:

a medium support section that has a supply section to which a continuous-shaped recording medium is supplied, a medium path through which the recording medium supplied to the supply section passes, and a transportation mechanism that transports the recording medium; and a recording section that performs recording on the recording medium passing through the medium path, wherein a hole that is formed in a side wall, the sidewall having a light shielding property and the hole being capable of enabling a user to visually recognize the inside of the medium path on the upstream side from the transportation mechanism in a transportation direction through the inside of the medium support section is provided in the medium support section, wherein the medium support section is capable of relatively moving with respect to the recording section, and wherein an opening of the hole on the side opposite the medium path is exposed when the medium support section relatively moves from a position in which the recording medium is transported to the recording section.

2. A recording apparatus, comprising:

a medium support section that has a supply section to which a continuous-shaped recording medium is supplied, a medium path through which the recording medium supplied to the supply section passes, and a transportation mechanism that transports the recording medium; and a recording section that performs recording on the recording medium passing through the medium path, wherein a hole that is formed in a side wall, the sidewall having a light shielding property and the hole being capable of enabling a user to visually recognize the inside of the medium path on the upstream side from the transportation mechanism in a transportation direction through the inside of the medium support section is provided in the medium support section, wherein the opening of the hole on the side opposite the medium path is wider than that of the hole on the side of medium path.

3. The recording apparatus according to claim 1, wherein a plurality of holes are provided in positions which are different in a width direction of the recording medium passing through the medium path.

4. The recording apparatus according to claim 1, wherein the transportation mechanism has a detector that detects presence or absence of the recording medium inside the medium path.

5. The recording apparatus according to claim 1, wherein the medium support section has an internal housing in which at least the transportation mechanism is provided, and wherein a side wall in which the hole is formed is configured as a separate member that is mounted on the internal housing.

6. The recording apparatus according to claim 2, wherein a plurality of holes are provided in positions which are different in a width direction of the recording medium passing through the medium path.

7. The recording apparatus according to claim 2, wherein the transportation mechanism has a detector that detects presence or absence of the recording medium inside the medium path.

8. The recording apparatus according to claim 2, wherein the medium support section has an internal housing in which at least the transportation mechanism is provided, and wherein a side wall in which the hole is formed is configured as a separate member that is mounted on the internal housing.

* * * * *